US009013273B2

(12) United States Patent
Oh et al.

(10) Patent No.: US 9,013,273 B2
(45) Date of Patent: Apr. 21, 2015

(54) METHOD OF CONTROLLING ELECTRIC DEVICE

(75) Inventors: Minjin Oh, Changwon-si (KR); Seonghwan Kang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/613,216

(22) Filed: Sep. 13, 2012

(65) Prior Publication Data

US 2013/0076488 A1 Mar. 28, 2013

(30) Foreign Application Priority Data

Sep. 22, 2011 (KR) ..... 10-2011-0095557

(51) Int. Cl.
*G08B 5/22* (2006.01)
*G06G 1/14* (2006.01)
*F25D 29/00* (2006.01)

(52) U.S. Cl.
CPC ..... *F25D 29/00* (2013.01)

(58) Field of Classification Search
USPC ..... 340/3.1; 348/14.3; 707/3
See application file for complete search history.

(56) References Cited

U.S. PATENT DOCUMENTS 6,785,670 B1 * 8/2004 Chiang et al. ..... 707/706
6,807,463 B1 * 10/2004 Cunningham et al. ..... 700/304
8,199,019 B2 * 6/2012 Kaczmarz et al. ..... 340/585
8,223,134 B1 * 7/2012 Forstall et al. ..... 345/173
8,371,135 B2 * 2/2013 Lee ..... 62/127
8,468,064 B1 * 6/2013 Trandal et al. ..... 705/26.7
2002/0016739 A1 * 2/2002 Ogasawara ..... 705/22
2002/0057847 A1 * 5/2002 Hayashi et al. ..... 382/282
2002/0059175 A1 * 5/2002 Nakano ..... 707/1
2003/0208333 A1 * 11/2003 Starling et al. ..... 702/135
2004/0021701 A1 * 2/2004 Iwema et al. ..... 345/863
2004/0100380 A1 * 5/2004 Lindsay et al. ..... 340/540
2005/0137943 A1 * 6/2005 Holzman ..... 705/28
2007/0152048 A1 * 7/2007 Jung et al. ..... 235/385
2009/0090127 A1 * 4/2009 Do ..... 62/449
2009/0099873 A1 * 4/2009 Kurple ..... 705/3
2009/0231132 A1 * 9/2009 Shoenfeld ..... 340/542
2010/0100647 A1 * 4/2010 Takizawa et al. ..... 710/14
2010/0201720 A1 * 8/2010 Zampini et al. ..... 345/690
2010/0283573 A1 * 11/2010 Yum et al. ..... 340/3.1
2010/0289808 A1 * 11/2010 Hitaka ..... 345/581
2010/0325004 A1 * 12/2010 Schoettle ..... 705/26
2010/0331043 A1 * 12/2010 Chapman et al. ..... 455/556.1
2011/0019917 A1 * 1/2011 Cantral ..... 382/190
2011/0102336 A1 * 5/2011 Seok et al. ..... 345/173
2011/0125561 A1 * 5/2011 Marcus ..... 705/14.15
2012/0013540 A1 * 1/2012 Hogan ..... 345/173

* cited by examiner

*Primary Examiner* — Van T. Trieu
*Assistant Examiner* — Royit Yu
(74) *Attorney, Agent, or Firm* — KED & Associates LLP

(57) ABSTRACT

A method for controlling an electronic device is provided. The method may include displaying, on a display, information related to at least one of a plurality of items to be managed or processed by the device, selecting at least one piece of item information displayed on the display, recognizing the selected piece of item information, and storing the recognized piece of item information into a memory as an object to be managed or processed by the device.

13 Claims, 22 Drawing Sheets

METHOD OF CONTROLLING ELECTRIC DEVICE

CROSS-REFERENCE TO RELATED APPLICATION(S)

This application claims priority under 35 U.S.C. §119 to Korean Application No. 10-2011-0095557 filed on Sep. 22, 2011, whose entire disclosure(s) is/are hereby incorporated by reference.

BACKGROUND

1. Field

This relates to a method for controlling an electric device.

2. Background

Various electric devices may manage/process information and provide various functions using electricity as a power source. In, for example a refrigerator, a user may manage and process much of the management information (e.g., an amount of stock, expiration date and the like) of food stored in the refrigerator in order to consume food having an imminent expiration date or to plan to replenish certain food items. In, for example, a washing machine, properties of materials of clothes or washing methods may be checked by the user before operating the washing machine. In, for example, a cooking apparatus cooking methods may be checked by the user before cooking.

BRIEF DESCRIPTION OF THE DRAWINGS

The embodiments will be described in detail with reference to the following drawings in which like reference numerals refer to like elements wherein.

DETAILED DESCRIPTION

Hereinafter, various embodiments will be described in detail with reference to the accompanying drawings.

Figure 1:
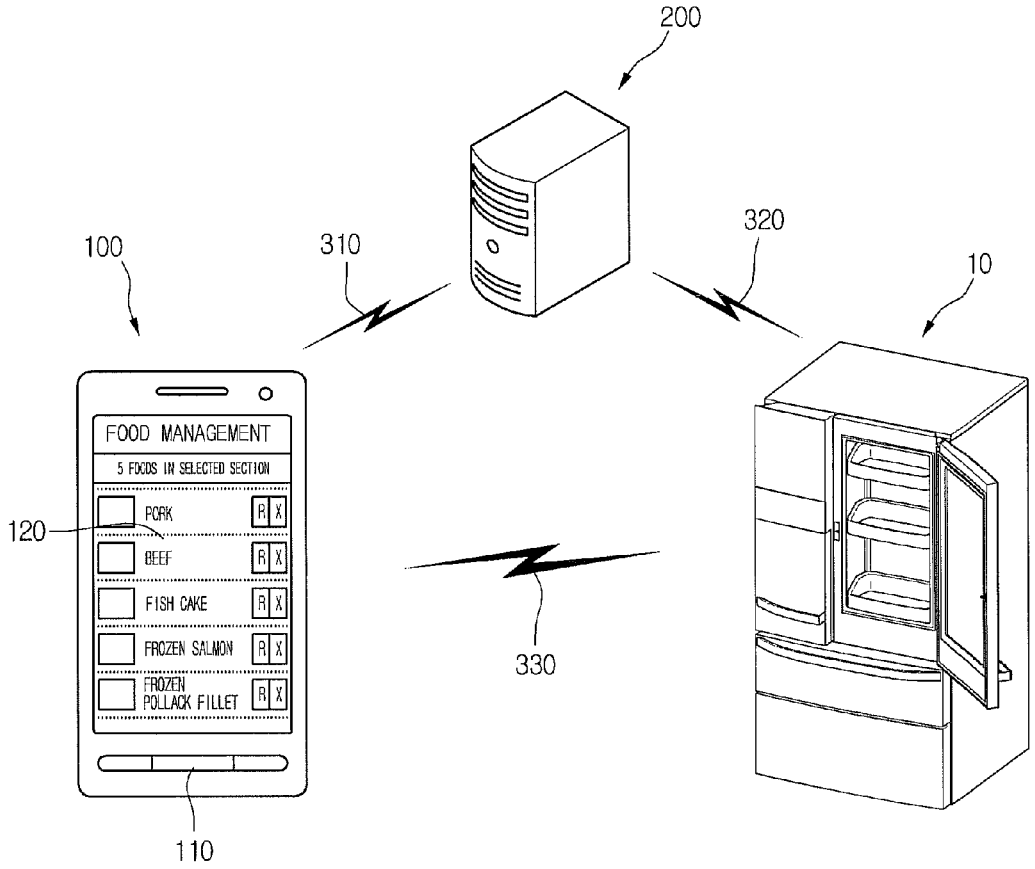
FIG. 1 is a diagram of a network system according to an embodiment as broadly described herein.
Figure 2:
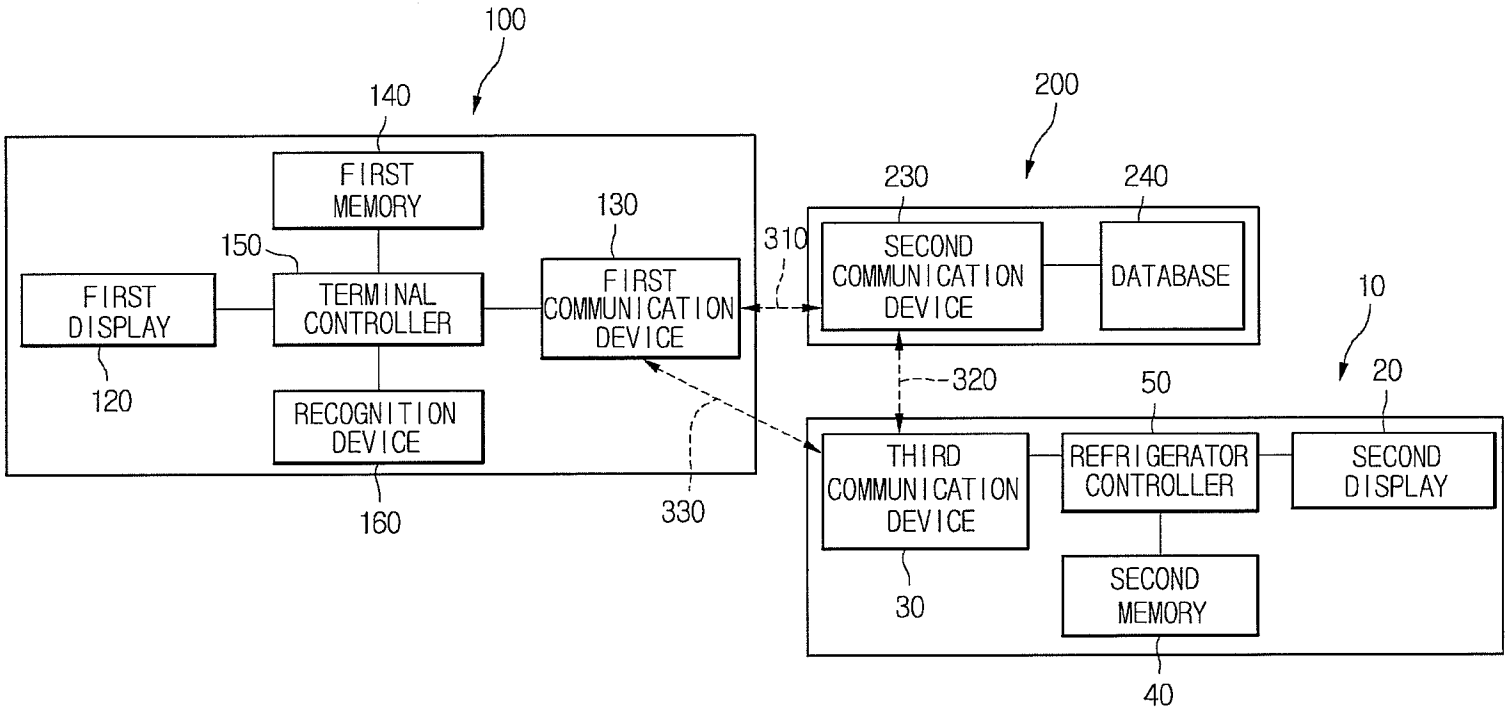
FIG. 2 is a block diagram of the network system shown in FIG. 1.

Referring to FIGS. 1 and 2, a network system 1 as embodied and broadly described herein may include an electric device, for example, a refrigerator 10 which generates cold air and stores various items, such as, for example, food, a terminal 100 which is capable of communicating with the refrigerator 10 and recognizes information related to the food, and a server 200 which is capable of communicating with the refrigerator 10 and the terminal 100 and stores certain data.

The terminal 100 may include an input device 110 for inputting certain commands to the items stored in the refrigerator 10 and a first display 120 for displaying information related to the items. For example, the terminal 100 may be a cell phone or smartphone, a desktop or laptop computer, or other such device as appropriate.

The network system 1 may include a first interface 310 defined between the terminal 100 and the server 200, a second interface 320 defined between the server 200 and the refrigerator 10, and a third interface 330 defined between the terminal 100 and the refrigerator 10. At least one of a variety of communication techniques, such as WiFi, ZigBee, Bluetooth, and Internet for transmitting information, may be adopted as the first, second and third interfaces 310, 320 and 330.

As shown in FIG. 2, the terminal 100 may include a first communication device 130 capable of communicating with the refrigerator 10 or the server 200, a first memory 140 which stores information transmitted from the first communication device 130 or operating information on the terminal 100, a recognition device 160 which recognizes the information related to the items stored in the refrigerator 10, and a terminal controller 150 which controls an operation of the terminal 100.

The server 200 may include a second communication device 230 capable of communicating with the first communication device 130 and a database 240 which stores the information related to the items stored in the refrigerator 10.

The refrigerator 10 may include a third communication device 30 capable of communicating with the first communication device 130 and the second communication device 230, a second display 20 for displaying the information related to the items, a second memory 40 which stores the information related to the items, and a refrigerator controller 50 which controls an operation of the refrigerator 10.

The food-related information may include information, for example, related to the food itself, or food management information. The information related to the food itself may include, for example, a food name, an amount of food, a number of pieces of food, and the like and the food management information may include, for example, a location of the food stored in the refrigerator, a period of storage, an amount of stock, a freshness period/expiration date, a storage method and the like. This type of food-related information may be obtained from various sources, such as, for example, a certain object to be recognized, such as, for example, a receipt, a food container, a barcode, or encrypted information.

The first memory 140, the second memory 40, and/or the database 240 may include the food-related information. The information stored in one of the first or second memory 140/40 may be synchronized with that of the other of the first or second memory 140/40. Herein, the first memory 140, the second memory 40, and the database 240 may be collectively referred to as a storage device.

While the first memory 140 is synchronized with the second memory 40, the database 240 of the server 200 may be used. As a matter of course, the terminal 100 may directly communicate with the refrigerator 10 to synchronize the first and second memory 140 and 40. For example, information recognized via the terminal 100 may be transmitted to the refrigerator 10 via the server 200 or may be directly transmitted to the refrigerator 10.

Further, information that is not stored in the terminal 100 or the refrigerator 10 of the information stored in the database 240 of the server 200 may be transmitted to the terminal 100 or to the refrigerator 10. That is, the terminal 100 or the refrigerator 100 may download or update the information stored in the database 240.

Figure 3:
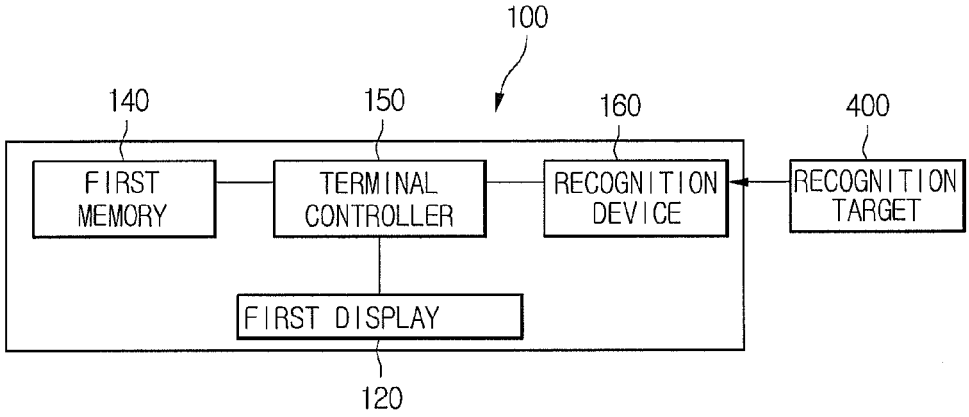
FIG. 3 is a block diagram of interaction between a terminal and a recognition target according to an embodiment as broadly described herein.
Figure 4:
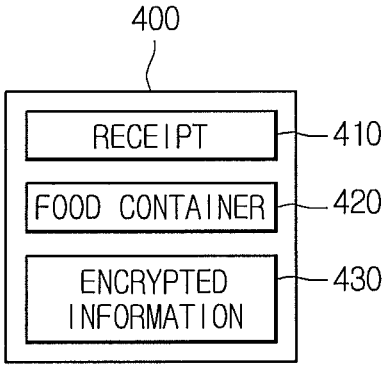
FIG. 4 is a block diagram of a recognition target according to an embodiment as broadly described herein.

FIG. 3 is a block diagram illustrating interaction between a terminal and a recognition target according to embodiment as broadly described herein, and FIG. 4 is a block diagram of the recognition target shown in FIG. 3.

Referring to FIGS. 3 and 4, the terminal 100 may include a recognition device 160 for recognizing a recognition target 400. The recognition device 160 may be a device for recognizing certain information included with the recognition target 400. The recognition device 160 may be referred to as a consumable reader or a consumable holder. Herein, the term "consumable" may be used to refer to food stored in a refrigerator, and the term "reader" may be used to refer to a device for reading information on the consumable.

The consumable reader may include an image-capturing device (or camera), an RFID reader, or a barcode reader, and a consumable holder may include a shelf or a basket. The shelf or basket may include, for example, a weight sensor for detecting the weight of food, and the weight of food may be read by the weight sensor.

Such a weight sensor may be considered a consumable reader in that the weight sensor detects certain information, i.e., the weight of the particular food item in a particular container, or may be considered the consumable holder in that the sensor is provided with a device for supporting the item in the refrigerator.

The recognition target 400 may include a receipt 410 including a certain letter, symbol, number, shape, color, or pattern that corresponds to a certain item. The letter, symbol, number, shape, color, and pattern are together referred to as appointed information.

The recognition target 400 may also include a food container 420 accommodating food therein. The food container 420 may include the appointed information.

The recognition target 400 may also include encrypted information 430 encrypted according to a certain rule. The encrypted information 430 may include a barcode, a QR code, or an RFID tag. The encrypted information 430 may be included on the receipt 410 or the food container 420.

The information provided on the recognition target 400 may be recognized by the recognition device 160. For example, the appointed information may be recognized by the camera, and the encrypted information 430 may be recognized by the camera, barcode reader, or RFID.

Figure 5:
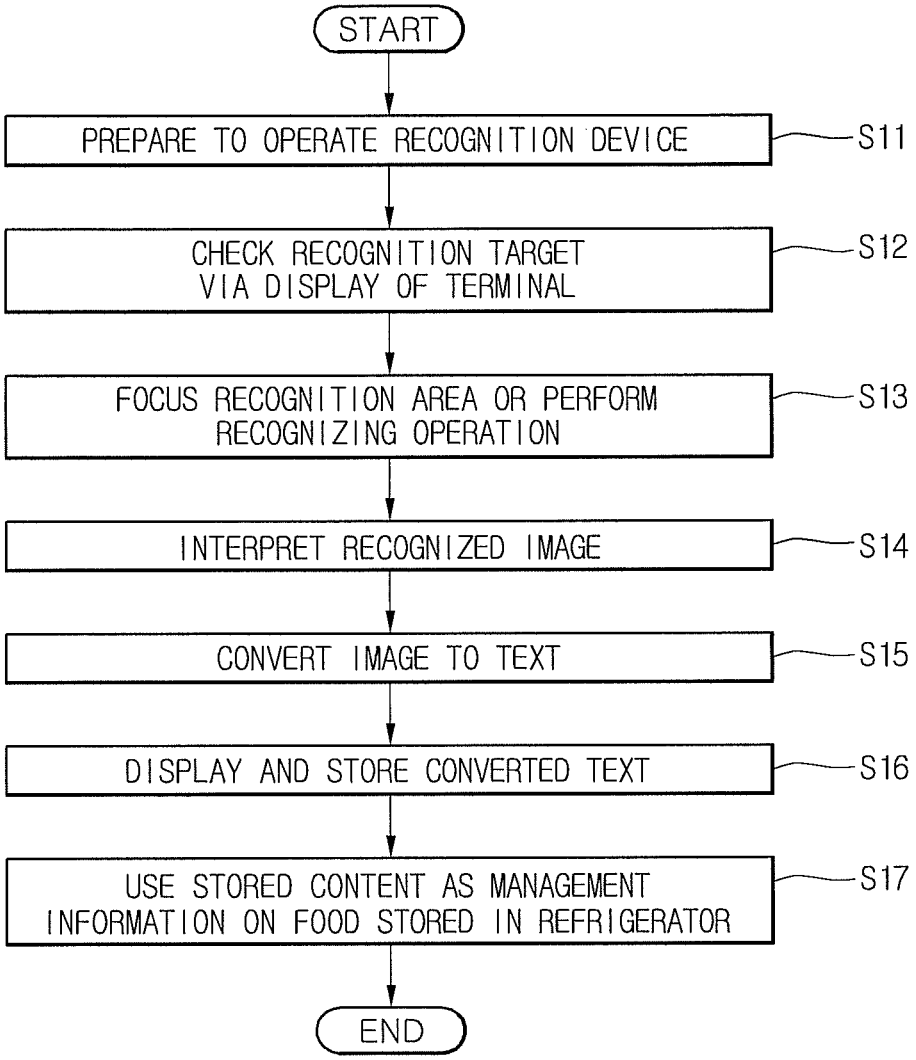
FIG. 5 is a flowchart of a method for operating a recognition device according to an embodiment as broadly described herein.

FIG. 5 is a flowchart of a method for operating the recognition device according to an embodiment as broadly described herein.

By operating the terminal 100, operation of the recognition device 160 may be initiated in operation S11. In operation S12, the recognition target 140 is checked via the first display 120. In operation S13, the recognition target 400 is displayed on the first display 120 so as to be focused, or an image is obtained by performing a recognizing operation, for example, an image-capturing operation of the camera.

In certain embodiments, the recognized information may be stored in the first memory 140 or the database 240.

By using an information recognizing program, the recognized image may be interpreted in operation S14, and the image may be converted into text in operation S15 on the basis of the interpreted information. More specifically, in order to interpret the recognized information, the information recognizing program may be installed on the terminal 100 or the server 200. The information recognizing program may interpret the recognized information (or image) to convert the recognized information to food-related information corresponding to the recognized information.

The food-related information may be displayed in a text format. The displayed information may include information related to the food itself (e.g., food name and amount of food) or food management information (e.g., expiration date). As a matter of course, the information related to the food itself or the food management information may be previously stored in the first memory 140 or the database 240, in operations S14 and S15.

The converted text may be displayed on the display 120 and stored in the first memory 140 or the database 240 in operation S16. Further, information on the converted text may be synchronized with the refrigerator 10 so as to be displayed on the second display 20 in operation S16.

The information stored in the first memory 140 or the database 240 may be synchronized with the second memory 40 of the refrigerator 10 and may be used as food management information in operation S17.

For example, in the case in which food information to be stored in the second memory 40 of the refrigerator 10 is recognized by controlling the recognition device 160, the recognized information may be stored in the terminal 100, the refrigerator 10, or the server 200. More specifically, when food related to the recognized information is determined (e.g., inputted to a certain input unit) to be included in a management target of the refrigerator, the determined information may be stored in the first memory 140, the second memory 40, or the database 240.

While food is stored (or stocked) in the refrigerator, information related to a storage location or storage period of the food may be additionally recognized (manually or automatically), and the additionally recognized information may be stored in connection with the corresponding food. In certain embodiments, the automatic recognition may be performed by at least one of the consumable reader or the consumable holder.

While food is taken out from the refrigerator, the recognized information or the additionally recognized information may be displayed on the first display 120 or the second display 20. Further, when the food is completely taken out from the refrigerator, the recognized information or the additionally recognized information may be deleted in operation S17.

As described above, the information recognized and stored in the recognition device 160 may be used for managing food stored in the refrigerator. Further, the terminal 100 may perform remote monitoring or remote control to manage food stored in the refrigerator 10.

Figure 6:
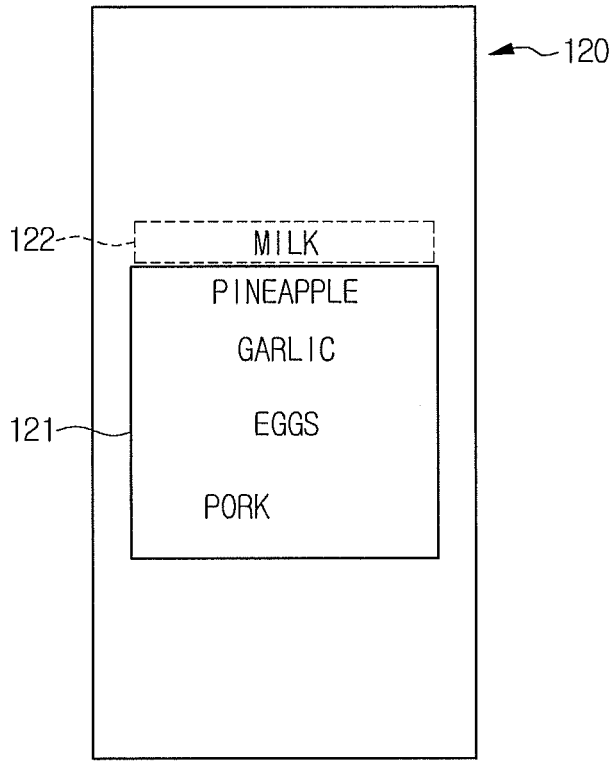
FIGS. 6 and 7 illustrate a display of a terminal according to an embodiment as broadly described herein.
Figure 7:
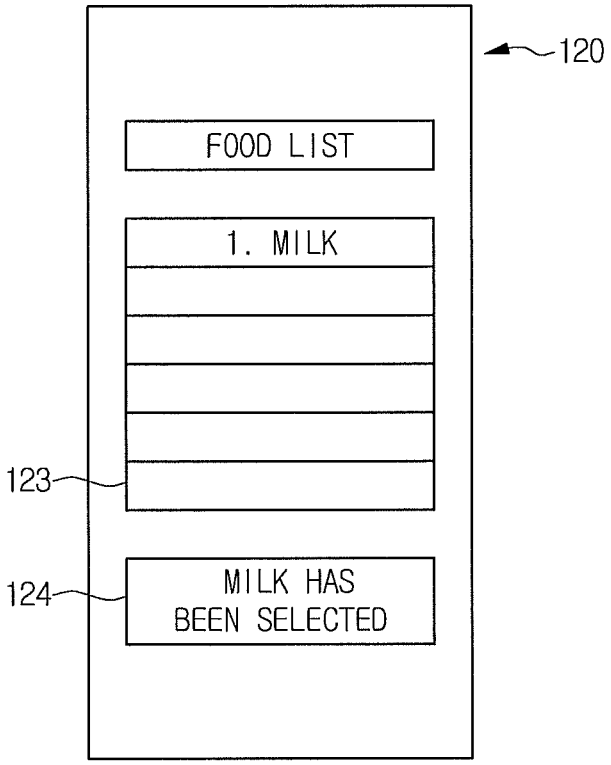

FIGS. 6 and 7 illustrate a display of a terminal according to an embodiment as broadly described herein.

Referring to FIGS. 6 and 7, item information recorded on the recognition target 400 may be recognized via the terminal 100 in this embodiment. The first display 120 may include an item information display 121 on which information on an item to be recognized may be displayed.

More specifically, when the recognition device 160 (e.g., camera) of the terminal 100 faces the recognition target 400, e.g., the receipt 410, information on the item written on the receipt 410 may be displayed on the first display 120. As illustrated in FIG. 6, the information may include a specific listing including, for example, "milk", "pineapple", "garlic", "eggs", "pork", and other such items to be stored in a refrigerator 10.

Further, a recognition area 122 defined by, for example, a line is displayed on the first display 120 in order to provide a guide to a location of an item to be recognized. The recognition area 122 may be displayed in the form of a box so as to be easily recognized by a user. A location of the recognition device 160 may be adjusted so that one piece of item information, for example, "milk", is located within the recognition area 122.

In a state in which the item information is located within the recognition area 122, when a set time has elapsed or the input device 110 provided on the terminal 100 is pushed, an operation for recognizing the item information may be performed. The recognizing operation may interpret the information written on the recognition target 400 and convert the information to text.

When the recognizing operation is performed, a food list may be displayed on the first display 120 as illustrated in FIG. 7. More specifically, the first display 120 may include a list display 123 on which recognized food information is listed and a recognition result display 124 which indicates that particular item information has been selected and recognized.

When particular item information, for example, "milk", is recognized, the recognition result display 124 may display a message of "milk has been selected", and the list display 123 may include the recognized item information, i.e., "milk", in the list. The item information included in the list may then become an object of management or processing and stored in the first memory 140.

As described above, since the item information may be selected by focusing the recognition area on the item information displayed on the first display 120, ease of use may be improved.

Hereinafter, various alternative embodiments will be described. Since these embodiments may be different from the first embodiment with respect to selection of item information or recognition technique, detailed description will focus on the differences. Further, the same reference numerals and descriptions will be maintained for the same or similar elements as the first embodiment and the previous embodiment.

Figure 8:
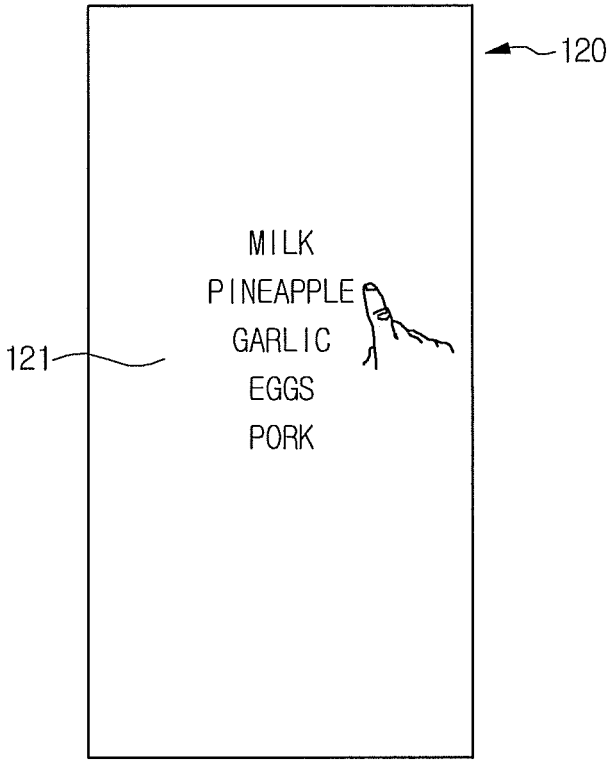
FIGS. 8 and 9 illustrate a display of a terminal according to another embodiment as broadly described herein.
Figure 9:
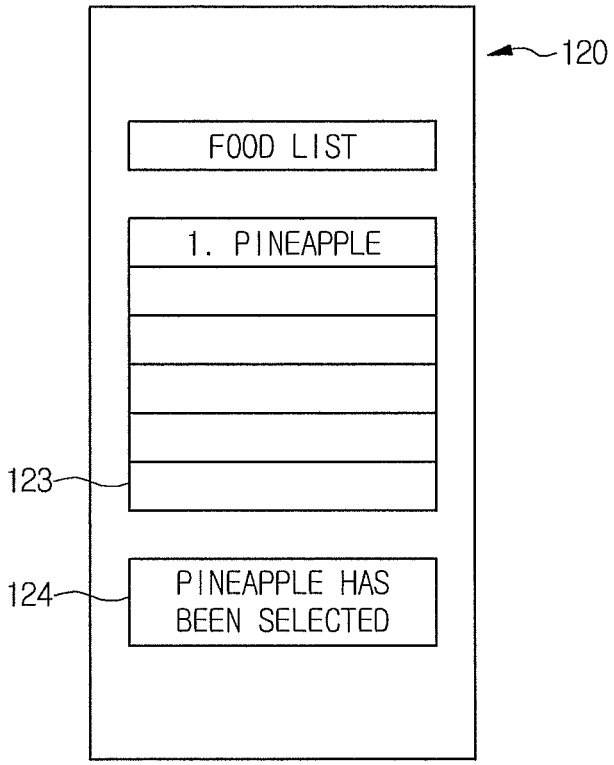

In the embodiment shown in FIGS. 8 and 9, the first display 120 includes an item information display 121 on which item information written on the recognition target 400 is displayed. As described above with respect to the previous embodiment, the item information displayed on the item information display 121 may be obtained via the recognition device 160.

A user may use a selection device to select item information corresponding at least one item to be recognized, such as, for example, a touch pen, a user's hand or finger, an input device, or other pointing/selection implement as appropriate.

For example, a user may touch (or click once) a location adjacent to one piece of item information from among a plurality of pieces of item information, e.g., "pineapple", by using a finger. Further, item information located on an area laterally extended from the touch location may be selected as an object to be recognized. When the selected item information is recognized, as illustrated in FIG. 9, the recognized item information may be displayed on the first display 120. As described above with respect to the previous embodiment, the selected item information may be recognized when a set time has elapsed or a certain command has been received at the input device 110.

More specifically, a message of "pineapple has been selected" may be displayed on the recognition result display 124, and "pineapple" may be displayed on the list display 123. The item information displayed on the list display 123 may then become an object of management or processing and be stored in the first memory 140.

Although it has been described, in connection with FIG. 8, that only one piece of item information is touched and selected, a plurality of pieces of item information may be touched and selected. For example, when "pineapple", "garlic", and "pork" are sequentially selected, the item display 123 may display "1. Pineapple, 2. Garlic, 3. Pork".

As described above, since the item information to be managed or processed may be selected by a touching technique or the like in a state in which the item information is displayed on the first display 120, ease of use may be improved.

Figure 10:
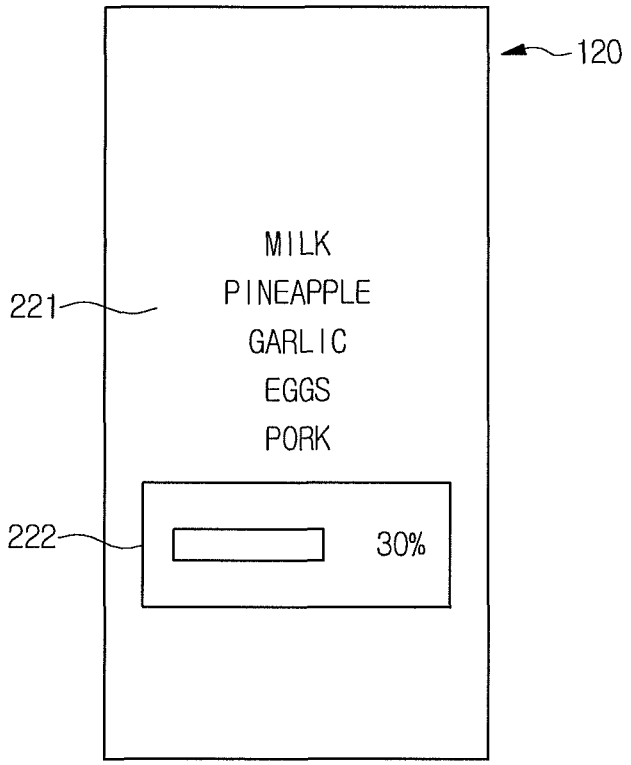
FIGS. 10 to 13 illustrate a display of a terminal according to another embodiment as broadly described herein.

FIGS. 10 to 13 are diagrams illustrating a display of a terminal according to another embodiment. Referring to FIG. 10, the first display 120 may include a captured-image information display 221 which displays an image obtained via the recognition device 160, i.e., an image related to the item information, and a recognition progress display 222 which displays a progress ratio of recognizing the image information when the image related to the item information is captured.

In a state in which the item information is displayed on the captured-image information display 221, when a certain command is received at the input device 110, an information recognizing operation for displaying the item information on a list may be performed. While the information recognizing operation is performed, the recognition progress display 222 may display progress, e.g., from 0% to 100%, as time passes.

Figure 11:
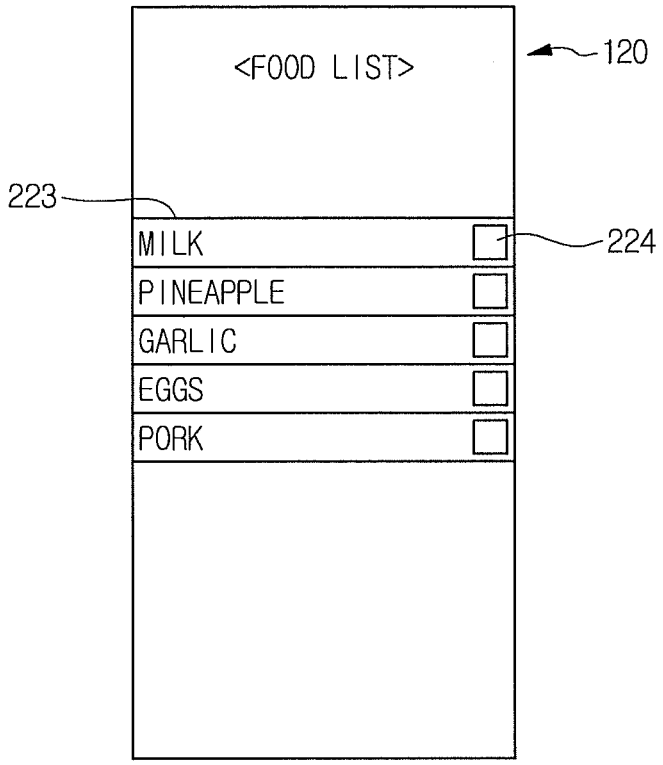

When the progress ratio reaches 100%, i.e., when the recognizing operation is completed, the first display 120 may display the at least one piece of item information which has been displayed on the captured-image information display 221, as illustrated in FIG. 11.

More specifically, in this embodiment the first display 120 may include a recognized-list display 223 which displays names of the item information and selection button(s) 224 for selecting whether to include the item information displayed on the recognized-list display 223 with objects to be managed or processed.

Figure 12:
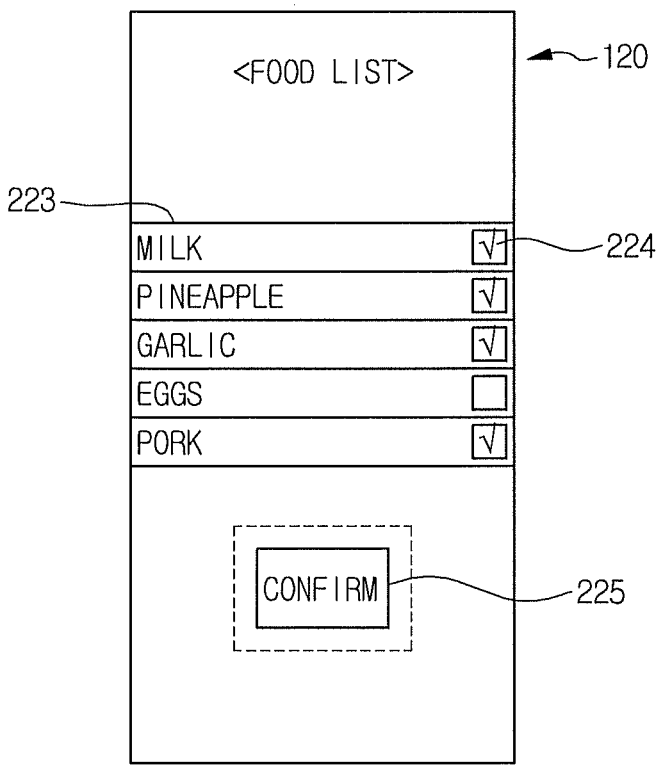

A user may select the selection button(s) 224 corresponding to the item information to be managed or processed by using a selection implement, i.e., a user's finger, a touch pen, a stylus or other input device as appropriate. When particular item information is selected, the selection display 224 corresponding to the selected item information may be marked with a tick, as illustrated in FIG. 12.

Figure 13:
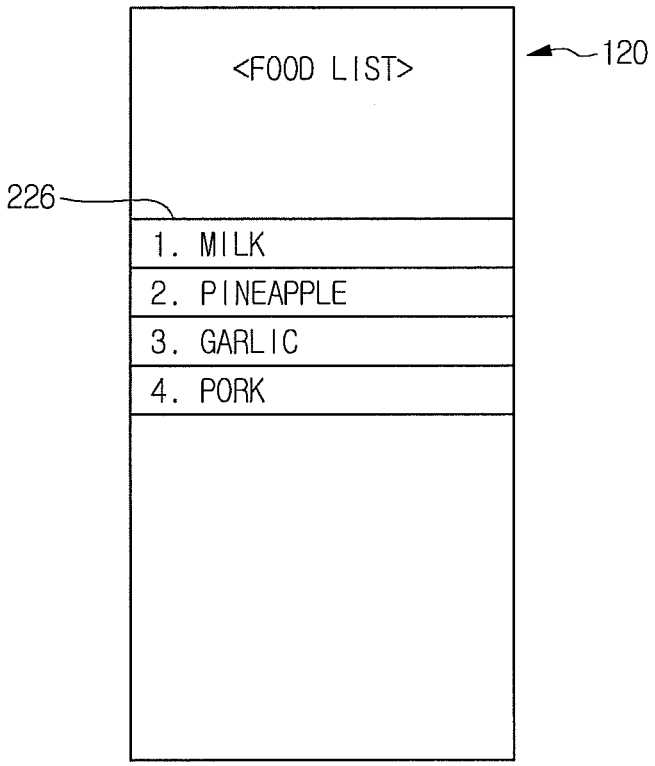

Further, when a confirmation input button 225 displayed on the first display 120 is selected, the first display 120 may display a stored-list display 226 as illustrated in FIG. 13. The item information displayed on the stored-list display unit 226 may be used as information for a managing or processing operation of an electric device.

As described above, since desired item information may be easily selected after recognizing a plurality of pieces of item information by capturing an image via the recognition device 160, ease of use may be improved.

Figure 14:
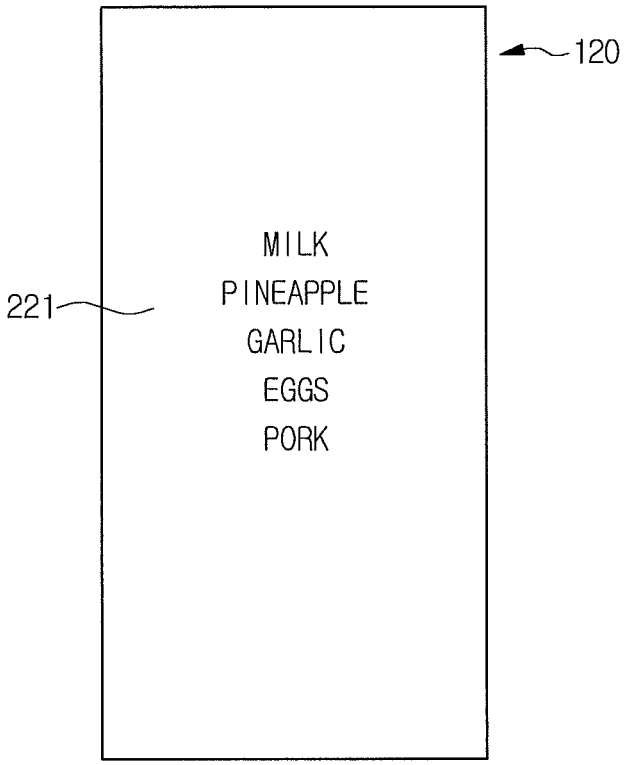
FIGS. 14 to 16 illustrate a display of a terminal according to another embodiment.
Figure 15:
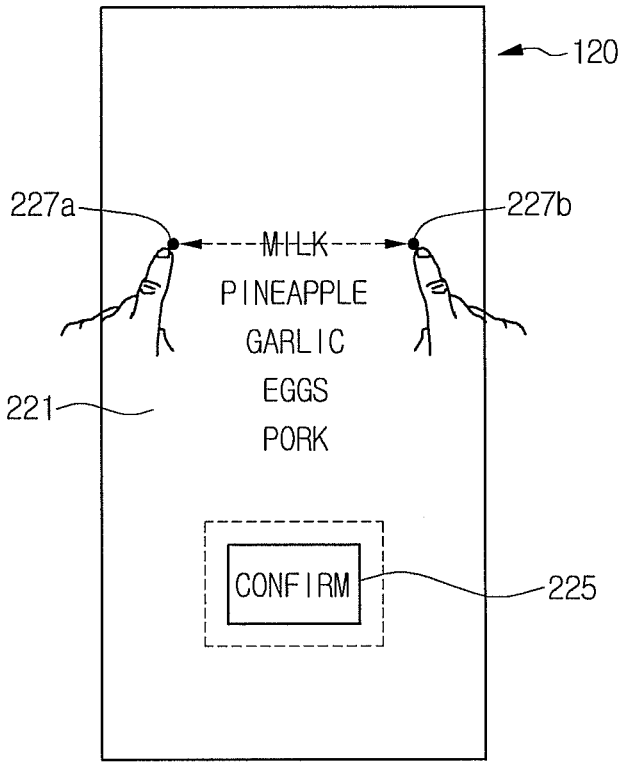
Figure 16:
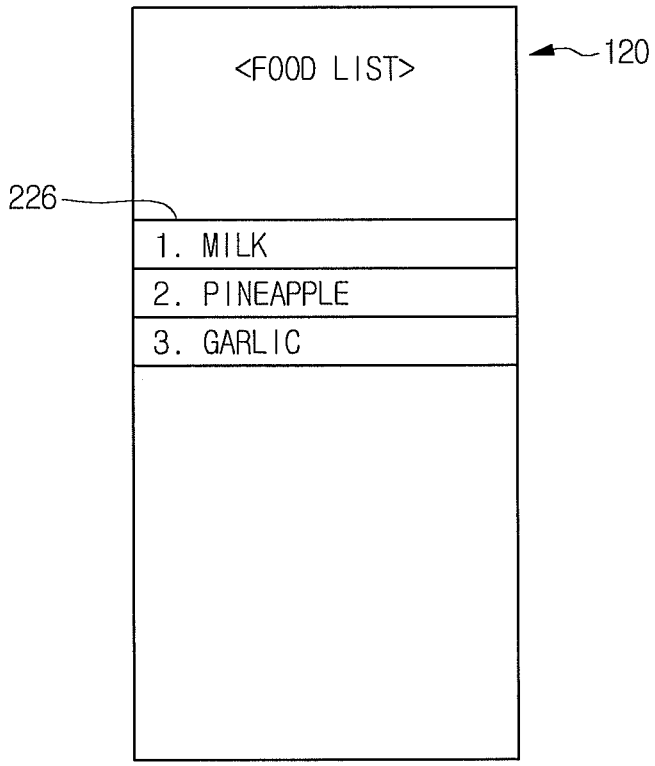

FIGS. 14 to 16 are diagrams illustrating a display of a terminal according to another embodiment. Referring to FIG. 14, the display 120 may include a captured-image information display 221 which displays information on items of which images have been captured via the recognition device 160.

A user may select at least one item from the item information displayed on the captured-image display 221 by using an appropriate selection device. For example, as illustrated in FIG. 15, the user may select a particular item by sliding a finger or a touch pen along the display 120 from a touch start point 227*a* defined at one end of the item to a touch end point 227*b* defined at the other end of the item.

The touch start point 227*a* and/or the touch end point 227*b* does not necessarily refer to a certain single point, but may be considered as a boundary defining a certain area for selecting the corresponding item information. Therefore, within the whole display area of the first display 120, the touch start point 227*a* and/or the touch end point 227*b* may be formed at various different locations and may be defined at an inner area or outer area of the item information. For example, when the plurality of pieces of item information are vertically arranged, the touch start point 227*a* and the touch end point 227*b* may be horizontally arranged.

Although it is illustrated in FIG. 15 that only one piece of item information, i.e., "milk", is selected, another piece of item information, e.g., "garlic" or "pork", may also be selected. That is, the user may sequentially select additional pieces of item information by touching an area on which the item information is displayed.

Further, when the confirmation input button 225 is selected, the first display 120 may display the stored-list display 226 on which recognized pieces of item information are sequentially displayed, as illustrated in FIG. 16. FIG. 16 illustrates the stored-list display 226 generated in the case where "banana", "garlic", and "pork" have been sequentially selected.

As described above, since the item information may be selected by using a touching technique, ease of use may be improved.

Figure 17:
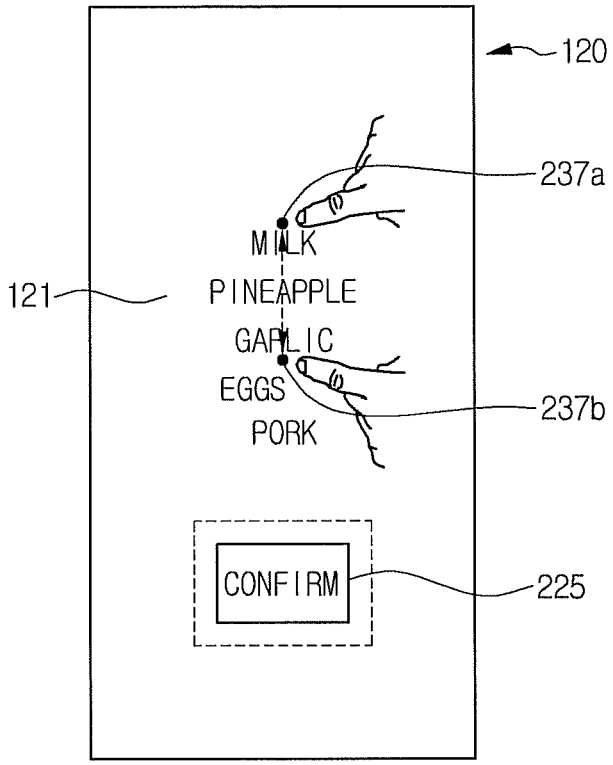
FIGS. 17 and 18 illustrate a display of a terminal according to another embodiment as broadly described herein.
Figure 18:
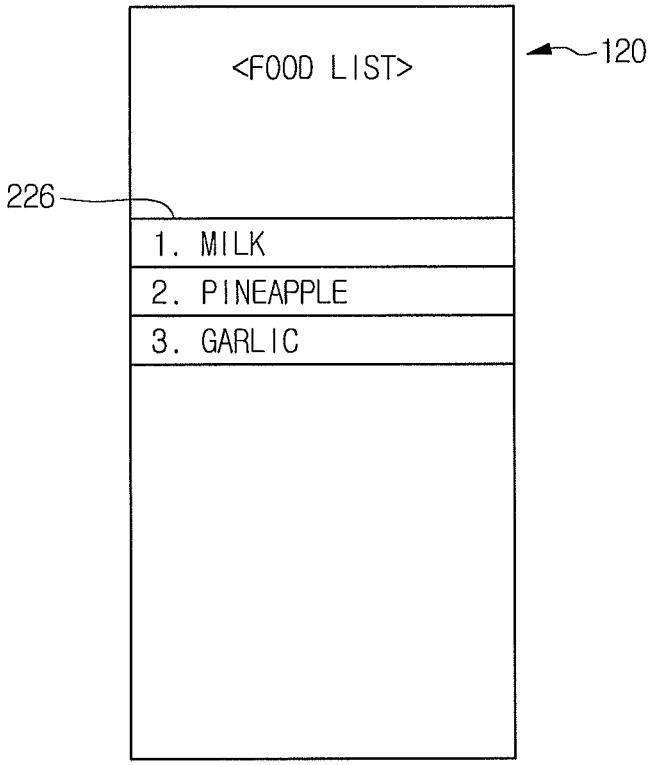

FIGS. 17 and 18 are diagrams illustrating a display of a terminal according to another embodiment. Referring to FIG. 17, the first display 120 may include a captured-image information display 221 which displays information on items of which images have been captured via the recognition device 160.

A user may select at least one item from the item information displayed on the captured-image display 221 using an appropriate selection device. For example, as illustrated in FIG. 17, the user may select at least one piece of the item information by sliding a finger or a touch pen along the display 120 from a touch start point 237*a* defined at or near one piece of the item information to a touch end point 237*b* defined at or near another piece of the item information.

That is, the touch start point 237*a* and the touch end point 237*b* may define a start point and an end point for sequentially selecting different pieces of the item information at once. For example, when a plurality of pieces of item information are vertically arranged, the touch start point 237*a* and the touch end point 237*b* may be horizontally separated from each other.

As described above, in a state in which one piece of the item information is touched, if the touch area is extended to an area on which another piece of the item information is displayed, pieces of the item information located within the touch area may be recognized at once. Therefore, a plurality of item information may be easily selected and recognized.

When the touch start point 237*a* and the touch end point 237*b* are located within an area where one piece of the item information is displayed, the number of selected pieces of the item information may be one.

Further, in a state in which at least one piece of the item information is selected, if the confirmation input button 225 is then selected, the first display 120 may display the stored-list display 226 on which recognized pieces of the item information are sequentially displayed, as illustrated in FIG. 18. FIG. 18 illustrates the stored-list display 226 generated in the case where "milk", "garlic", and "pork" are located in the touch area.

Figure 19:
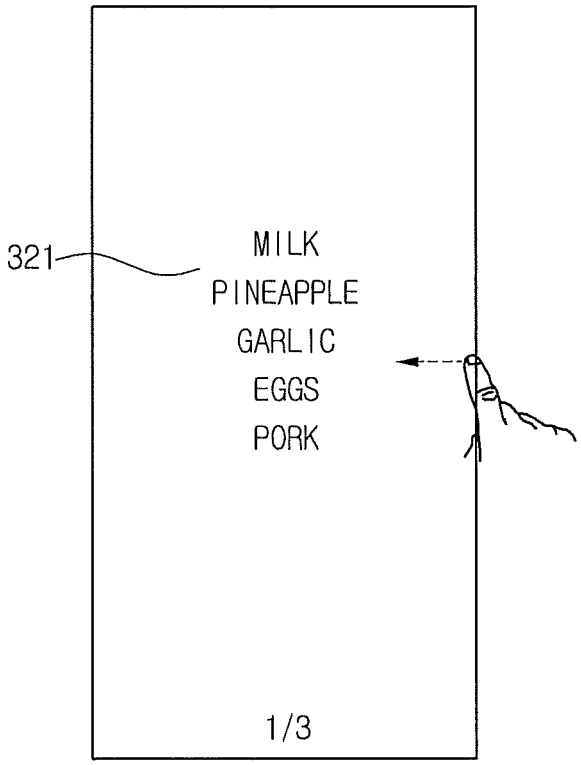
FIGS. 19 to 21 illustrate a display of a terminal according to another embodiment as broadly described herein.
Figure 20:
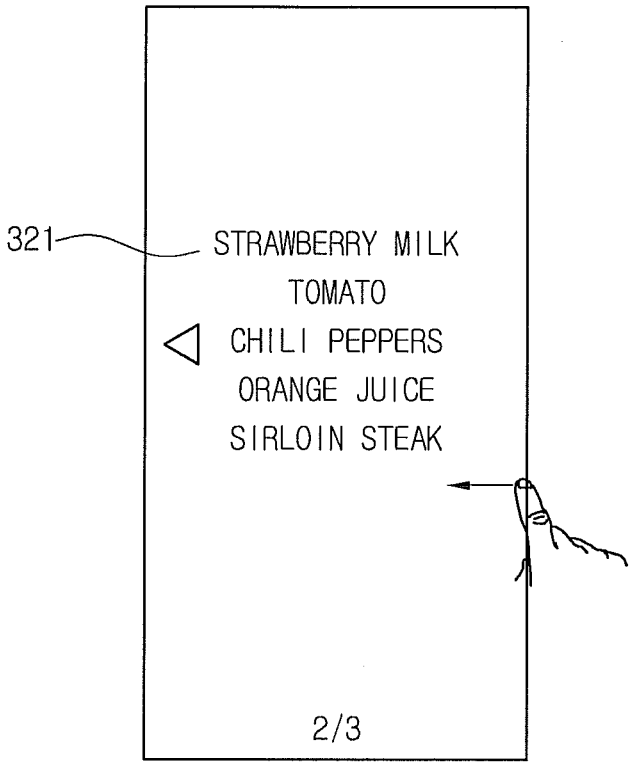
Figure 21:
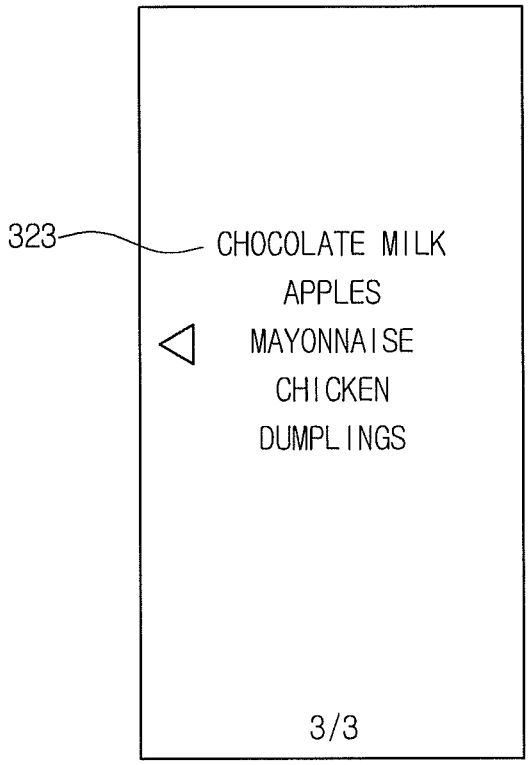

FIGS. 19 to 21 are diagrams illustrating a display of a terminal according to another embodiment. Referring to FIG. 19, in the case in which an amount of the item information written on the recognition target 400, e.g., the receipt 410, is great, or in the case in which the length of the receipt 410 is too long to capture an image of all the item information at once, the image of the item information may be captured several times.

For example, as illustrated in FIGS. 19 to 21, a plurality of pieces of the item information may be captured three times via the recognition device 160, and information on the captured images may be distributed onto three screens. That is, a first captured-image information display 321, a second captured-image information display 322, and a third captured-image information display 323 may each display different pieces of the item information. At the bottom of the first display 120, a sequence indicator of the three screens, e.g., "1/3", "2/3", or "3/3", may be displayed. A user may switch between the screens by performing a touching or sliding operation.

At least one piece of the item information displayed on the first, second and third captured-image information display 321, 322 and 323 may be selected or recognized in the same manner as described above with respect to the previous embodiments. According to this configuration, a plurality of pieces of item information may be selected or controlled.

In the exemplary embodiments described above with respect to FIGS. 6-7, 8-9, 10-13, 14-16, 17-18, and 19-21, the item information was dedicated to food stored in a refrigerator. However, embodiments as broadly described herein are not limited thereto. That is, the item information may be related to clothes to be processed by a washing machine, or related to food to be cooked by a cooking apparatus.

Figure 22:
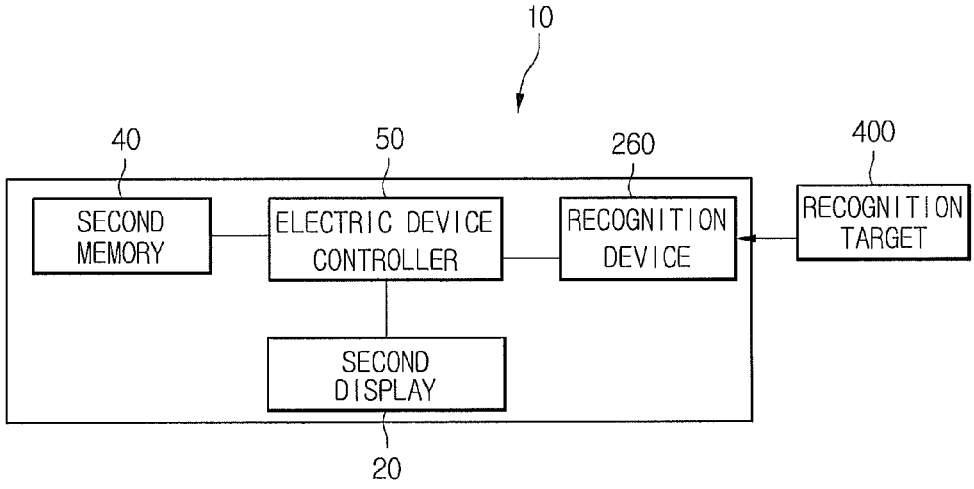
FIG. 22 is a block diagram of interaction between an electric device and a recognition target, according to another embodiment as broadly described herein.

FIG. 22 is a block diagram illustrating interaction between an electric device and a recognition target, according to an embodiment as broadly described herein.

Referring to FIG. 22, an electric device 15 may include a recognition device 260 for recognizing a recognition target 400. For example, the electric device 15 may include a camera, a barcode, and/or an RFID reader.

That is, without making use of an additional terminal 100, information included in the recognition target 400 may be directly recognized by the recognition device 260 provided with the electric device 15. Further, on the basis of the recognized information, management of the food to be managed or processed by the electric device 15 may be performed. Additionally, the recognized information related to the food may be stored in the server 200 or the terminal 100, and the terminal 100 may perform remote monitoring or remote control for items to be managed or processed by the electric device 15. Thus, since the recognition device 260 may be provided with either the terminal 100 or the electric device 15, the display device for obtaining or recognizing an image of item information may be the first display 120 of the terminal 100 or the second display 20 of the electric device.

According to embodiments as broadly described herein, information on a particular object used in an electric device may be checked, and according to a result of the checking, management or processing of the particular object may be efficiently performed.

A recognition device may be provided with an electric device or a terminal so that information written on a receipt or a food container or encrypted information may be recognized. Therefore, recognition of information on a particular object may be easily performed.

Further, on the basis of the information recognized by the recognition device, the object may be managed or processed according to characteristics of the electric device, thereby reducing errors on the management or processing of the object.

Further, information related to the object may be recognized a user having to memorize or track the contents perform a special recognizing operation. Thus, ease of use may be improved.

Embodiments provide a method for controlling an electric device to allow the electric device to recognize information on an object that is to be processed using a terminal.

In one embodiment as broadly described herein, a method for controlling an electric device may include displaying, on a display unit, information on at least one item to be managed or processed by the electric device, selecting at least one piece of the item information displayed on the display unit, recognizing the selected piece of the item information, and storing the recognized piece of the item information into a memory unit as an object to be managed or processed by the electric device.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for identifying food items received in a refrigerator, the method comprising:

focusing on an area of a receipt in which images of a plurality of food items are located, using a camera;

displaying a recognition area defined by a line surrounding the images of the plurality of food items located in the focused area;

capturing a plurality of user captured images corresponding to the plurality of food items;

executing an information recognizing program and converting at least one letter recognized in each user captured image into text and generating a text listing including the converted text corresponding to the plurality of user captured images;

displaying the text listing including the converted text on a display, each item of the converted text corresponding to one of the plurality of items included in the receipt;

selecting texts of at least two lines corresponding to first and second items from the text listing displayed on the display, the texts of the at least two lines including a first text corresponding to the first item and a second text located below the first text and corresponding to the second item, the selecting texts of the at least two lines comprising:

maintaining contact with the display from a start point corresponding to an upper portion of the first text to an end point corresponding to a lower portion of the second text, using a selection device, and storing the selected first and second texts corresponding to the first and the second items into a memory for processing, and thereby performing management of the first and the second items.

2. The method of claim 1, further comprising:

allowing a preset amount of time to elapse or receiving a command at an input device operably coupled to the display when the images of the plurality of food items are located in the recognition area.

3. The method of claim 1, wherein the texts of the at least two lines includes a third text corresponding to a third item from the displayed text listing, the third text being located below the second text on the display.

4. The method of claim 3, wherein the selecting texts of the at least two lines comprises:

maintaining contact with the display from the start point corresponding to the upper portion of the first text to an end point corresponding to a lower portion of the third text, to select the first text, the second text and the third text.

5. The method of claim 1, wherein the selection device comprises a finger.

6. The method of claim 1, wherein the selection device comprises a touch pen.

7. A method for identifying food items in a refrigerator, the method comprising:

focusing on an area of a receipt in which images of a plurality of food items are located, using a camera;

displaying a recognition area defined by a line surrounding the images of the plurality of food items located in the area;

capturing a plurality of captured images corresponding to the plurality of food items;

executing an information recognizing program and converting at least one letter recognized in each captured image into text and generating a text listing including the converted text corresponding to the plurality of captured images;

displaying the text listing including the converted text on a display, each item of the converted text corresponding to a separate one of the plurality of items included in the receipt;

selecting texts, from the displayed text listing, of at least two lines corresponding to first and second items, the texts of the at least two lines including a first text corresponding to the first item and a second text located below the first text on the display and corresponding to the second item, the selecting texts of the at least two lines comprising:

maintaining contact with the display between a first point corresponding to an portion of the first text and a second point corresponding to a portion of the second text, and storing the selected first and second texts corresponding to the first and the second items into a memory for processing, and thereby performing management of the first and the second items.

8. The method of claim 7, wherein maintaining contact includes providing a finger on the display between the first point and the second point.

9. The method of claim 8, wherein maintaining contact includes moving the finger on the display from the first point to the second point.

10. The method of claim 7, wherein maintaining contact includes providing a touch pen on the display between the first point and the second point.

11. The method of claim 10, wherein maintaining contact includes moving the touch pen on the display from the first point to the second point.

12. The method of claim 7, wherein the texts of the at least two lines includes a third text corresponding to a third item from the text listing displayed on the display, the third text being located below the second text on the display.

13. The method of claim 12, wherein the selecting texts of the at least two lines comprises:

maintaining contact with the display between the first point and a third point corresponding to a portion of the third text, to select the first text, the second text and the third text.

* * * * *